US005469669A

United States Patent [19]

Alter

[11] Patent Number: 5,469,669

[45] Date of Patent: Nov. 28, 1995

[54] THEATER DESIGN

[76] Inventor: Lloyd Alter, 38 Thome Crescent, Toronto, Ontario, Canada, M6H 2S5

[21] Appl. No.: 103,547

[22] Filed: Aug. 9, 1993

[51] Int. Cl.[6] ..... E04H 3/22

[52] U.S. Cl. ..... 52/8; 52/6

[58] Field of Search ..... 52/8, 6, 7, 9

[56] References Cited

U.S. PATENT DOCUMENTS

| | | | |
|---|---|---|---|
| 892,600 | 7/1908 | Littmann | 52/7 |
| 3,685,220 | 8/1972 | Morrison | 52/8 |
| 4,065,194 | 12/1977 | Mattia | 108/147 |
| 4,360,187 | 11/1982 | Chapman | 254/8 R |
| 4,950,126 | 8/1990 | Fabiano et al. | 414/590 |

FOREIGN PATENT DOCUMENTS

| | | | |
|---|---|---|---|
| 367863 | 1/1924 | Germany | 52/7 |

*Primary Examiner*—Michael Safavi

[57] ABSTRACT

A permanently fixed theater construction comprises a ground level lobby and a projection screen which are opposite ends of the construction. A seating region on a support floor is angled downwardly from the lobby into a pit towards the projection screen. An entrance to and an exit from the seating region are both provided at floor level through the lobby. There is a projection room with a projector in the lobby and the projection room includes a projection window above floor level of the lobby facing the projection screen. The projector itself is movable from a first set up and maintenance position at the floor level to a second operating position level with the projection window. The projector when moved to the operating position projects large format film to the screen.

2 Claims, 3 Drawing Sheets

THEATER DESIGN

FIELD OF THE INVENTION

The present invention relates to a theater construction specifically designed for large format film projection.

BACKGROUND OF THE INVENTION

IMAX Corporation, which is a Canadian corporation, operates theaters using giant screens for large format film projection. These giant screens which can be flat or domed shaped are many times larger than a conventional theater screen. However, an IMAX theater is not simply an enlargement of a conventional theater but rather uses innovative techniques to produce wide-angle, high fidelity images accompanied by high fidelity multi-channel sound. In conventional cinema theaters, the viewers simply passively sit and watch the film. In an IMAX theater or other similar large format film projection, the viewers actually feel as if they are participating in the cinema production. One of the key ingredients to the IMAX production is that the image on the screen occupies a lateral field of view of 60 to 120 degrees and a vertical field of view of 40 to 80 degrees, i.e. an extremely wide field of view which in fact extends to the edge of the peripheral vision of the viewers. In addition, the lower edge of the screen is positioned so that the viewers look down as well as up and to the sides of the screen which produces the effect of a natural horizon. As a result of all of these features, a film seen in a large format film projection theater is not simply an enlarged film but rather is a film giving a totally different feel from that of a conventional theater presentation.

IMAX and similar format theaters in themselves are relatively new. IMAX Corporation was only incorporated as recently as 1967. The theaters that they have built to date are relatively costly for a number of reasons. Firstly, a conventional IMAX theater has the entrance to the seating region at the base of the pit, which is at the bottom of the seating region and the exit at the upper end of the seating region. Although this ensures that visitors to the theater are always going up rather than down through the seating area which is found to be a safer method of entry and exit, there is a requirement for separate lobby levels for the exit and the entrance from the seating region which has added substantially to the cost of the theater.

In addition, in an IMAX theater the exit from the seating in the theater is at a level above ground level and the projection room is at yet another level above the exit level thereby necessitating yet another level for the projector. This multi-level design requires stairs, elevators, fire protection requirements, expensive elevated plumbing etc. in the lobby. Principally because of the multi-level lobby requirements noted immediately above, a conventional IMAX theater construction typically costs about four million dollars or more.

SUMMARY OF THE INVENTION

The present invention provides a permanently fixed theater construction for large format film projection such as that currently available through IMAX Corporation. However, the theater of the present invention is much simpler in design and of substantially reduced cost relative to the existing IMAX theaters. More particularly, the theater construction of the present invention has a pit area, a screen in the pit area, a seating region with an angled floor and tiered rows of seats supported on the floor, a ground level lobby, an entrance and an exit to and from the seating area with the entrance and the exit both being directly from the ground level lobby, a projection room containing a projector and a projection window in the lobby with the projection window being elevated from the ground level and means for lifting the projector from a lowered position beneath to a raised position level with the projection window.

By creating a single level lobby where patrons both enter and exit the seating area on the same level and without the requirement of an additional level specifically for the projector, the cost of the present invention theater is substantially reduced from a conventional IMAX theater.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
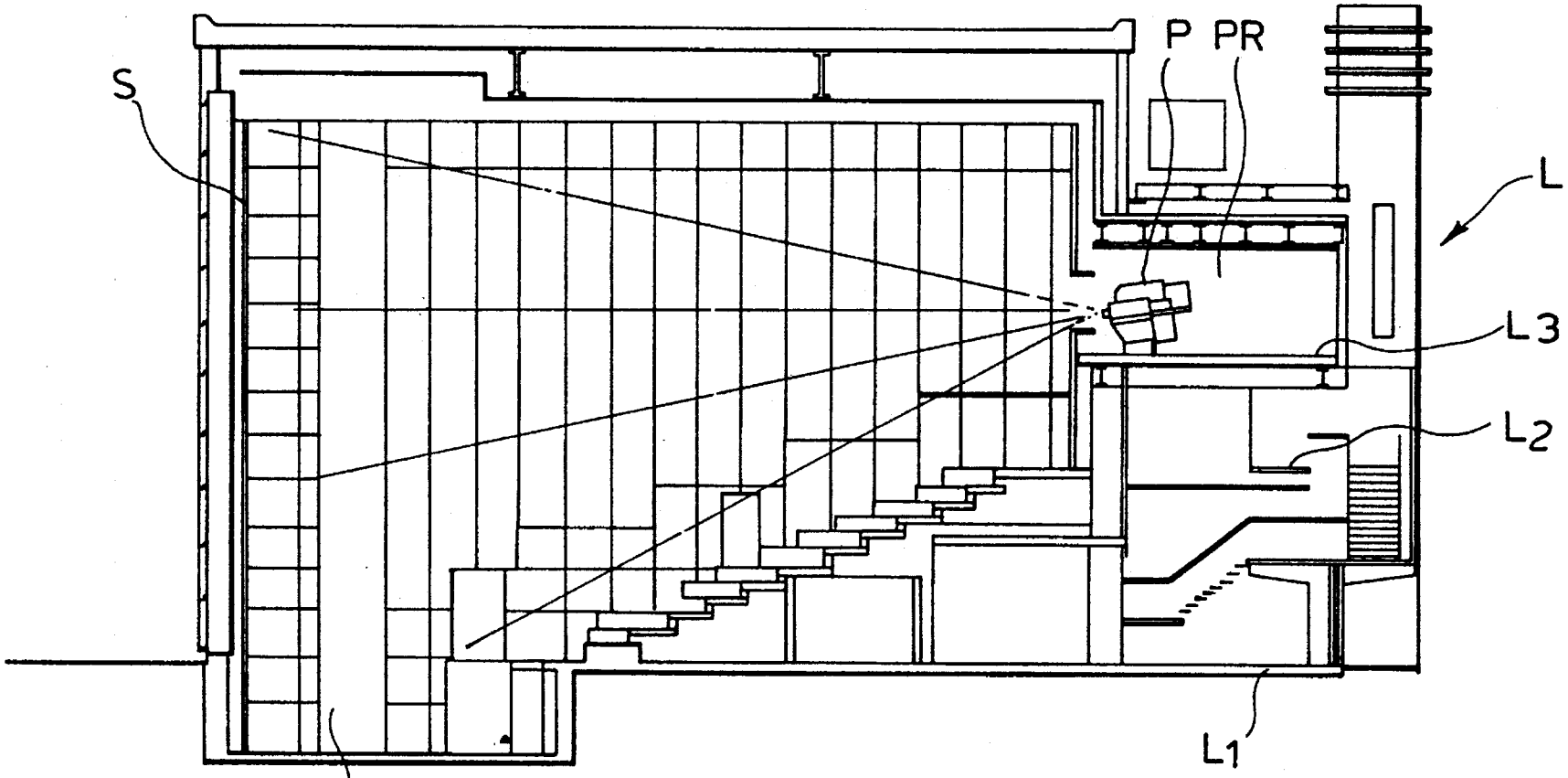
FIG. 1 is a sectional view through a conventional large format film projection theater. This figure is labelled PRIOR ART.

Before going into detail regarding the novel features of the present invention, reference is had to FIG. 1 showing a prior art large format film projection theater. This theater includes a giant screen S situated within the pit P of the theater. Rows of seats as shown face the screen. To the rear of the theater is a lobby generally indicated at L. This lobby includes a ground level L, which is the entrance level to the seating area. Level L2 is the exit level from the seating area. Two sets of stairs, as shown, are required between levels L1 and L2. A projector P is located in a projection room P.R. on yet another level L3. Note that in the prior art theater all of the seating is above ground level L1 requiting additional supporting structure for the seating area.

In this conventional design, patrons enter the theater near the bottom of the seating in the pit and climb up the stairs to their seats. When the show is over, they exit directly to level L2 and then down the stairs to level L1 through the lobby. In addition, because the projection room is in the upper level, there is a requirement for stairs and typically an elevator from the lower level of the lobby to the projection room.

Figure 2:
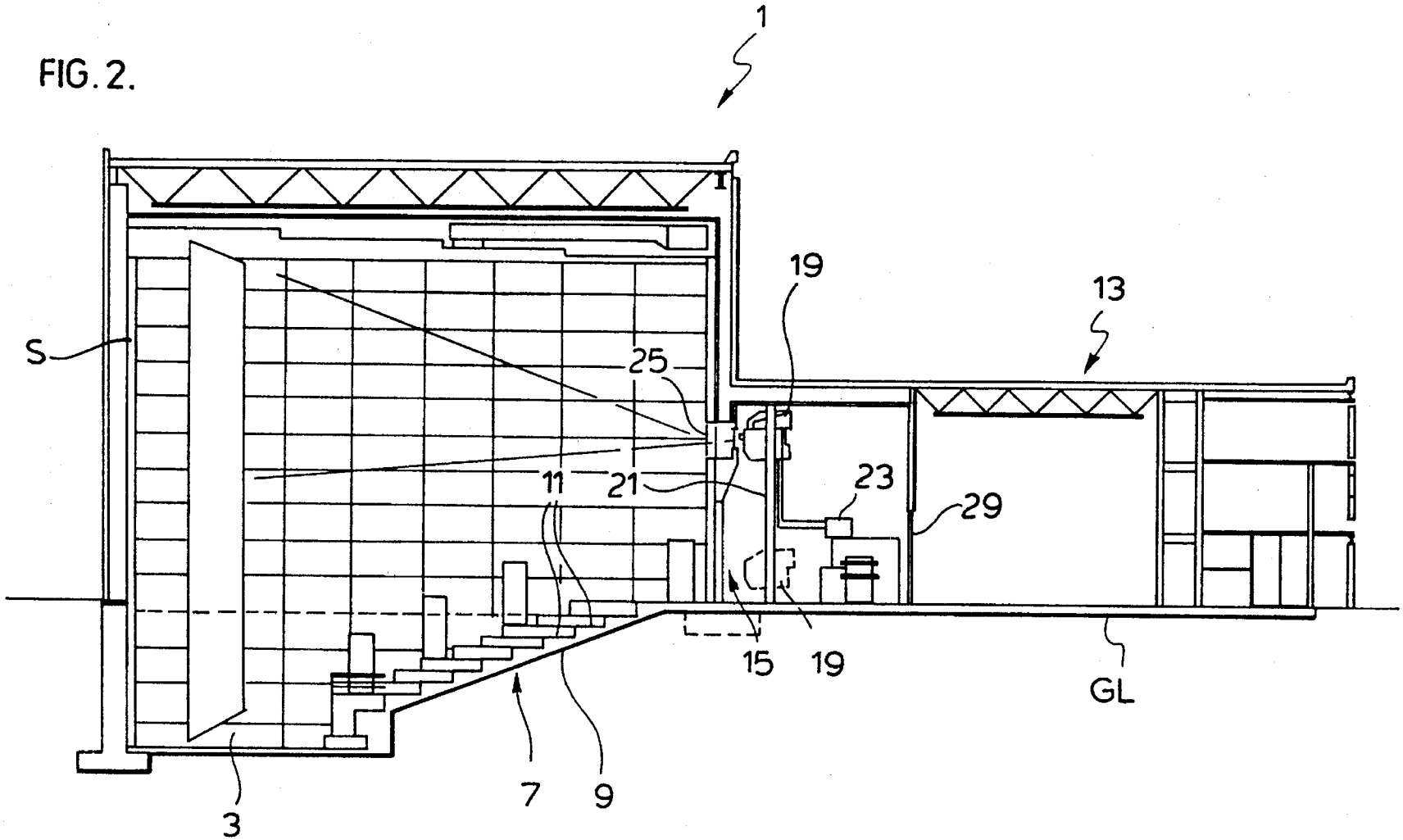
FIG. 2 is a sectional view through a large format film projection theater according to a preferred embodiment of the present invention.

FIG. 2 shows a present invention theater generally indicated at 1. This theater includes a pit 3 and a giant screen 5. Seating area generally indicated at 7 comprises an angled floor 9 and tiered seating 11 supported by the angled floor.

Located to the rear of the theater is a lobby generally indicated at 13. The floor of the lobby is located at ground level GL as indicated. Here it will be seen that all of the seating and the floor for the seating is located directly in the pit below ground level where the ground supports the floor and seating. This is to be contrasted to the prior art where above ground level supports are required for the seating.

The lobby has a direct access 15 to the seating area. The patrons both enter and exit their seats through access 15 of the lobby. They do not go up and down separate sets of stairs for entering and leaving the seating Also provided in the lobby is a projector 19. This projector is either mounted to or supported by a vertical lift 21. A projection window 25 is provided above ground level opening to the inside of the theater through the lobby as shown.

Projector 19 is moveable vertically from a relatively low position in the lobby as indicated in dotted lines to a raised position shown in solid lines where the projector is level with the projection window 25. A remote control 23 is used to operate the projector when it is in its raised position. However, for set up purposes and any maintenance required to the projector, it is easily dropped by means of lift 21 to its lowered position. As will be appreciated from this description, clearly there is no second level required in the lobby to support the projector at the projection window. Accordingly, the lobby does not require any stairs, elevators, expensive elevated plumbing etc. because it is all built on one level.

As an added feature, the projector area of the lobby is closed off from the public by means of a glass panel 29. This glass panel while preventing unauthorized entry or access to the projector does allow viewing to the projection area. This provides a very substantial interest factor to the theater patrons both at the time of entry and while exiting from the theater.

Figure 3:
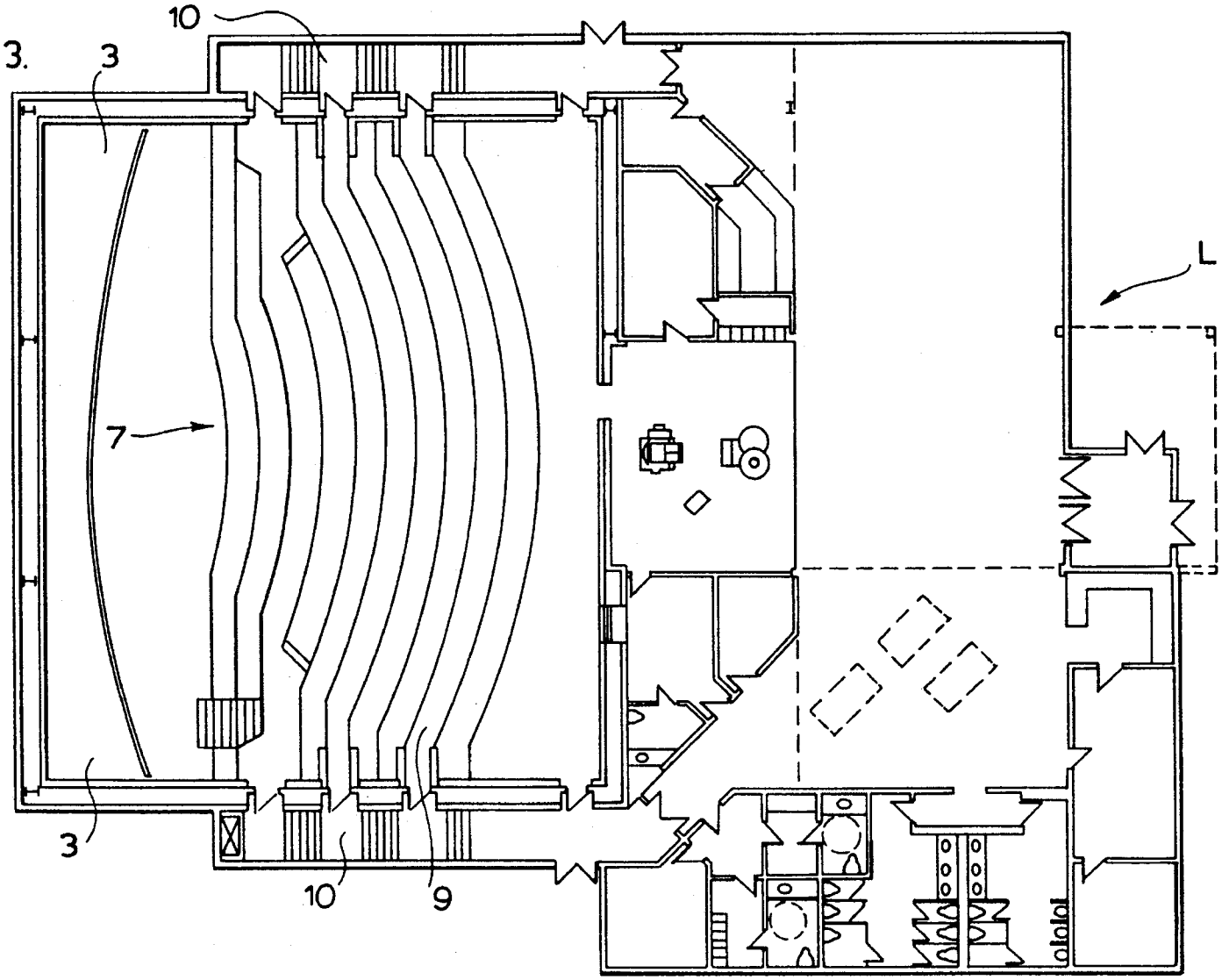
FIG. 3 view looking down on the theater of FIG. 2.

FIG. 3 of the drawings shows that access to the different rows of seats in the seating area 7 is provided by aisles 10 to opposite sides of the seats 9. Therefore, people entering the seating area from the lobby descend using the side aisles to their appropriate seating row. Both side aisles are relatively wide and include relatively short sections of steps interrupted by horizontal platforms which provide a much safer and more comfortable method of entry as opposed, for example, to a continuous length of stairway.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A permanently fixed theater construction comprising a ground level lobby and a projection screen which are at opposite ends of said construction, a seating region on a support floor in a pit excavated below ground level, said support floor being angled downwardly from said lobby towards said projection room into said pit, an entrance to and an exit from said seating region, both said entrance and said exit being through said lobby at the ground level, a projection room containing a projector in said lobby, a projection window out of said projection room facing said projection screen, said projector being movable from a first position at the ground level for maintenance and set up roof said projector to a second position elevated from the ground level to said projection window for operation of said projector, and a lift which moves said projector between said first and second positions, said projector when in said second position projecting large format film onto said projection screen.

2. A permanently fixed theater construction as claimed in claim 1 wherein said projection room has a transparent wall and said projector is viewable through said wall in said lobby.

* * * * *